US009816342B2

(12) United States Patent
Pedersen et al.

(10) Patent No.: US 9,816,342 B2
(45) Date of Patent: Nov. 14, 2017

(54) JUNK CATCHER AND A METHOD OF OPERATION OF SAME

(71) Applicant: Altus Intervention AS, Stavanger (NO)

(72) Inventors: Dag Ravn Pedersen, Narvik (NO); Robin Lovslett, Narvik (NO); Hassan Zakaria, Narvik (NO); Bard Martin Tinnen, Stavanger (NO)

(73) Assignee: Altus Intervention AS, Stavanger (NO)

( * ) Notice: Subject to any disclaimer, the term of this patent is extended or adjusted under 35 U.S.C. 154(b) by 247 days.

(21) Appl. No.: 14/786,605

(22) PCT Filed: Apr. 24, 2014

(86) PCT No.: PCT/NO2014/050063
§ 371 (c)(1),
(2) Date: Oct. 23, 2015

(87) PCT Pub. No.: WO2014/175750
PCT Pub. Date: Oct. 30, 2014

(65) Prior Publication Data

US 2016/0060989 A1 Mar. 3, 2016

(30) Foreign Application Priority Data

Apr. 25, 2013 (NO) ..... 20130569

(51) Int. Cl.
*E21B 31/14* (2006.01)
*E21B 23/06* (2006.01)
(Continued)

(52) U.S. Cl.
CPC ..... *E21B 31/00* (2013.01); *E21B 23/06* (2013.01); *E21B 27/00* (2013.01); *E21B 33/134* (2013.01); *E21B 34/06* (2013.01); *E21B 34/14* (2013.01)

(58) Field of Classification Search
CPC ..... E21B 31/00; E21B 33/134; E21B 23/06
(Continued)

(56) References Cited

U.S. PATENT DOCUMENTS 2,993,539 A 7/1961 Baker
3,189,096 A 6/1965 Phenix
(Continued)

FOREIGN PATENT DOCUMENTS

WO 2013164343 11/2013

*Primary Examiner* — Giovanna C Wright
*Assistant Examiner* — Nikhil Menon
(74) *Attorney, Agent, or Firm* — Gable Gotwals

(57) ABSTRACT

This invention relates to a junk catcher (2, 2') releasably connected to a retrievable bridge plug (4, 4') connectable to a setting tool (6) for joint deployment of bridge plug (4, 4') and junk catcher (2, 2') in a borehole (9) or a tubular in the borehole (9). Setting tool (6) extends through a fishing neck (12), a catcher tube (14), a flanged section (16), a valve chamber (18), a closable opening (20) and a portion of a setting sleeve (22, 22') of junk catcher (2, 2'). Valve chamber (18) comprises a valve (50) arranged to close closable opening (20) after retrieval of setting tool (6) from junk catcher (2, 2'). The junk catcher (2, 2') is connected to bridge plug (4, 4') by at least one shear bolt (27, 38). Bridge plug (4, 4') comprises a plug fishing neck (32, 32') facing junk catcher (2, 2'), and bridge plug (4, 4') comprises an equalizing channel (71) in a mandrel (7). The equalizing channel (71) extends from a bull nose (41) of bridge plug (4, 4'), and where junk catcher (2, 2') is provided with a closing sleeve (26, 26'), closing sleeve (26, 26') is connected to bridge plug (4, 4') by at least one shear bolt (38, 38'), and closing sleeve (26, 26') seals at least one equalizing port (73) in mandrel (7) when bridge plug (4, 4') is set. A method for operating bridge plug (4, 4') and junk catcher (2, 2') assembly is also described.

9 Claims, 6 Drawing Sheets

(51) Int. Cl.

| | |
|---|---|
| ***E21B 34/06*** | (2006.01) |
| ***E21B 31/00*** | (2006.01) |
| ***E21B 27/00*** | (2006.01) |
| ***E21B 33/134*** | (2006.01) |
| ***E21B 34/14*** | (2006.01) |

(58) Field of Classification Search
USPC ..... 166/99, 301
See application file for complete search history.

(56) References Cited

U.S. PATENT DOCUMENTS

| | | | | |
|---|---|---|---|---|
| 3,308,886 | A | 3/1967 | Evans | |
| 3,422,900 | A | 1/1969 | Hyde et al. | |
| 6,341,653 | B1 | 1/2002 | Firmaniuk et al. | |
| 2013/0228327 | A1 | 9/2013 | White et al. | |
| 2015/0300118 | A1* | 10/2015 | Hiorth ..... | E21B 23/01 166/99 |

* cited by examiner

JUNK CATCHER AND A METHOD OF OPERATION OF SAME

CROSS-REFERENCE TO RELATED APPLICATIONS

This application is the United States National Phase of Patent Application No. PCTN02014/050063filed 24 Apr. 2014, which claims priority to Norwegian Patent Application No. 20130569 filed 25 Apr. 2013, each of which is incorporated herein by reference.

There is provided a downhole apparatus that includes a junk catcher. More precisely there is provided a junk catcher and a retrievable bridge plug that is connectable to a setting tool for downhole placement. Even more precisely there is provided a junk catcher which is independently retrievable and where the junk catcher on retrieval opens a pressure equalizing channel in the bridge plug. The invention also includes a method of operation of the junk catcher. The apparatus is suited for use in a petrole-um well.

Plugs are often installed to create a temporary pressure barrier in a well. The plugs are typically installed by use of a setting tool and an adapter kit. The plugs are me-chanically connected to a setting tool. When the setting tool is activated, an axial force is generated between the setting tool and the plug in order to set the plug with an intended force in the well. When the correct setting force is reached, the setting tool and adapter kit are released from the plug and pulled out of the well. The releasing mechanism may consist of a shear bolt, a shear disc or other mechanical or electro-mechanical method of disconnecting.

After setting the plug, other well intervention operations may be carried out that may possibly result in debris or sand falling on top of the plug. Typical operations that could result in debris accumulated on the plug are perforation work or valve changes above the plug. The debris may be particles of for example metal, cement or rock. The debris and/or sand will, due to gravity, fall on top of the plug and potentially cause problems during later equalizing or retrieval of the plug.

Junk catchers are often used to prevent debris from causing problems by collecting the sand/debris inside a cylinder. The junk catcher may either be placed under the plug or above the plug.

Placed below the plug, the debris must fall through a plug mandrel and inside the junk catcher. The dimension of the plug mandrel is limiting the size of debris that will fall into the junk catcher. It is known that debris, even with this type of junk catcher pre-sent, can have a negative effect on the performance of the equalizing or the retrieval mechanism of the plug. This type of junk catcher is connected to the plug, and will be pulled along with the plug during retrieval of the plug.

Another known type of junk catcher is a tool that is placed above the plug. The installation and retrieval are both done in separate runs with related extra cost and time.

After retrieval of the junk catcher, the plug is retrieved. Prior to retrieval of the plug, the pressure under and above the plug should be equal. The retrieval tool first opens an equalizing valve and the operation pauses until the pressure has equalized. This takes time. Thereafter the plug is retrieved. As known in the art, pressure sensors are measuring the pressure within the well and at the well head and thereby the operating staff will know when it is safe to retrieve the plug. The well pressure in a gas producing well is more difficult to monitor as the gas is compressible and the gas may condense in the well. It is therefore more difficult to know if the pressure has equalized over the plug in a gas producing well. It is also more difficult to know if the equalizing valve has opened successfully.

Retrievable bridge plugs are known in the art, such as the retrieval plug disclosed in patent document GB2503202/WO2013164343 which is filed by the applicant and included herein its entirety by reference.

Patent document U.S. Pat. No. 6,341,653 discloses a junk basket and a retrievable bridge plug. The bridge plug and the junk basket are jointly deployed in a well bore. The basket is connected to the plug and a setting tool passes through the basket's bore and through a port in the basket's floor. The setting tool is removed once the plug is set, and a ball engages the port in the basket's floor. A retrieval tool engages with the basket's top sub and pulls out the basket. The pulling action causes shear screws to shear and the basket is separated from the bridge plug. The patent document is silent about any equalizing valve in the bridge plug. Patent document U.S. Pat. No. 2,993,539 discloses a junk basket and a retrievable bridge plug. The bridge plug and the junk basket are jointly deployed in a well bore. The basket is resting upon the bridge plug but not fixed to the plug. A rod assembly comprising a lower control rod and an upper auxiliary control rod runs through the basket's bore and floor, and through the bridge plug. The rod assembly is displaceable relative to the basket. The lower control rod engages a valve arrangement in the bridge plug as well as slips and the bridge plug's packing element. The rod assembly is operated by a running-in and retrieval tool. The running-in tool is removed once the plug is set. The basket and bridge plug is removed together by the retrieval tool. In the event the basket and bridge plug becomes stuck during retrieval, a pin is sheared and the upper auxiliary control rod is released from the lower control rod. The upper auxiliary control rod carries the basket upwardly and the stuck bridge plug is retrieved in a subsequent run.

The invention has for its object to remedy or reduce at least one of the drawbacks of the prior art or at least provide a useful alternative to the prior art.

The object is achieved through features which are specified in the description below and in the claims that follow.

The invention is defined by the independent claims. The dependent claims define advantageous embodiments of the invention.

According to a first aspect of the invention there is provided a junk catcher where the junk catcher is releasable connected to a retrievable bridge plug, the retrievable bridge plug being connectable to a setting tool for the deployment of the bridge plug and the junk catcher in a borehole or a tubular in the borehole, the setting tool is extending through a fishing neck, a catcher tube, a flanged section, a valve chamber, a closable opening and a portion of a setting sleeve of the junk catcher, the valve chamber comprises a valve arranged to close the closable opening after retrieval of the setting tool from the junk catcher, the junk catcher is connected to the bridge plug by at least one shear bolt, the bridge plug comprises a plug fishing neck facing the junk catcher, and the bridge plug comprises an equalizing channel in a mandrel, the equalizing channel extending from a bull nose of the bridge plug, and where the junk catcher is provided with a closing sleeve, the closing sleeve is connected to the bridge plug by at least one shear bolt, and the closing sleeve seals at least one equalizing port in the mandrel when the bridge plug is set. The retrievable bridge plug and the setting tool are typically connected by releasably joining a tool centre rod to the plug fishing neck in the usual way known to a skilled person. A collar on the setting tool is abutting a flange in the junk catcher. The setting sleeve is extending from the flange to the bridge plug. The flange and the setting sleeve may be seen as filling the function of an adapter kit according to prior art.

Other features may also be included in this part of the junk catcher, such as provision for related systems assembly, rigging up and keeping a setting sleeve under compression when running into the borehole.

During the setting operation of the plug, the setting tool is exerting an axial tension force through the tool centre rod. The force is counteracted by an axial compressive force through the flange and the setting sleeve.

When the plug is set the setting tool may be released from the plug, withdrawn from the junk catcher, where after the closable opening is closed. The junk catcher is then operational, catching and storing sand, metal particles and other debris while preventing them from reaching the bridge plug.

The bridge plug and junk catcher may be set in an open or cased borehole or in any suitable tubular positioned in a borehole.

The closing sleeve may seal an equalizing hole aligned with the equalizing port by enclosing the bridge plug's fishing neck from the outside.

In an alternative embodiment the closing sleeve may be positioned in an annulus between the plug fishing neck and the mandrel, and seals at least one equalizing port in the mandrel. The setting sleeve may comprise an internal shoulder positioned in an annulus between the setting sleeve and the plug fishing neck, the shoulder may upon axial displacement relative to the plug fishing neck abut a collar projecting over the plug fishing neck, and the collar is connected to the closing sleeve. The internal shoulder may be formed by a carrier sleeve, the carrier sleeve may be connected to and forming an elongation of the setting sleeve.

The closable opening may be equipped with a valve of any suitable type such as a flap valve or ball type valve. The valve may have an actuating device such as a spring or a gas spring intended for automatically closing the valve when the setting tool is removed.

It is also described a junk catcher and bridge plug assembly comprising a junk catcher as described above and where the bridge plug is provided with at least one equalizing port closable by a closing sleeve which is retrievable together with the junk catcher.

When the junk catcher is released or moved relative the bridge plug, the equalizing channel is opened, thus allowing the pressures on both sides of the bridge plug to be equalized. The equalizing process will normally commence as the junk catcher is released from the bridge plug, but may in some cases be delayed by use of delaying means.

After the junk catcher is removed from the borehole, the plug may be retrieved by use of a conventional pulling tool. As only minor quantities of sand or debris will be present on top of the plug the connection of the pulling tool to the plug is much simplified compared to prior art.

According to a second aspect of the invention there is provided a method of operation of a junk catcher as described above, the method includes:

connecting the junk catcher that has a closable opening for a setting tool, to a retrievable bridge plug;

connecting the setting tool to the bridge plug;

positioning the junk catcher and the bridge plug downhole;

setting the bridge plug; and retrieving the setting tool, where the method further includes:

retrieving the junk catcher together with a closing sleeve which on retrieval displaces axially along a plug fishing neck of the bridge plug; and opening at least one equalizing port in a mandrel by the displacement of the closing sleeve such that an open channel forms from a bull nose and through the bridge plug, such that pressure may equalize under and above the bridge plug when the junk catcher is retrieved.

The method may further comprise to inspect the junk catcher for the presence of the closing sleeve at the surface to confirm that the at least one equalizing port has been opened.

The systems outlined above are suitable for both over and under balanced situations.

The assembly and method according to the invention substantially simplifies the retrieval of a plug as the top of the plug is kept free of sand and debris, thus avoiding connecting problems between the plug and retrieval tool. Further, no time is lost for separate run of the junk catcher.

Below, examples of preferred embodiments and methods are explained under reference to the enclosed drawings, where:

Figure 1:
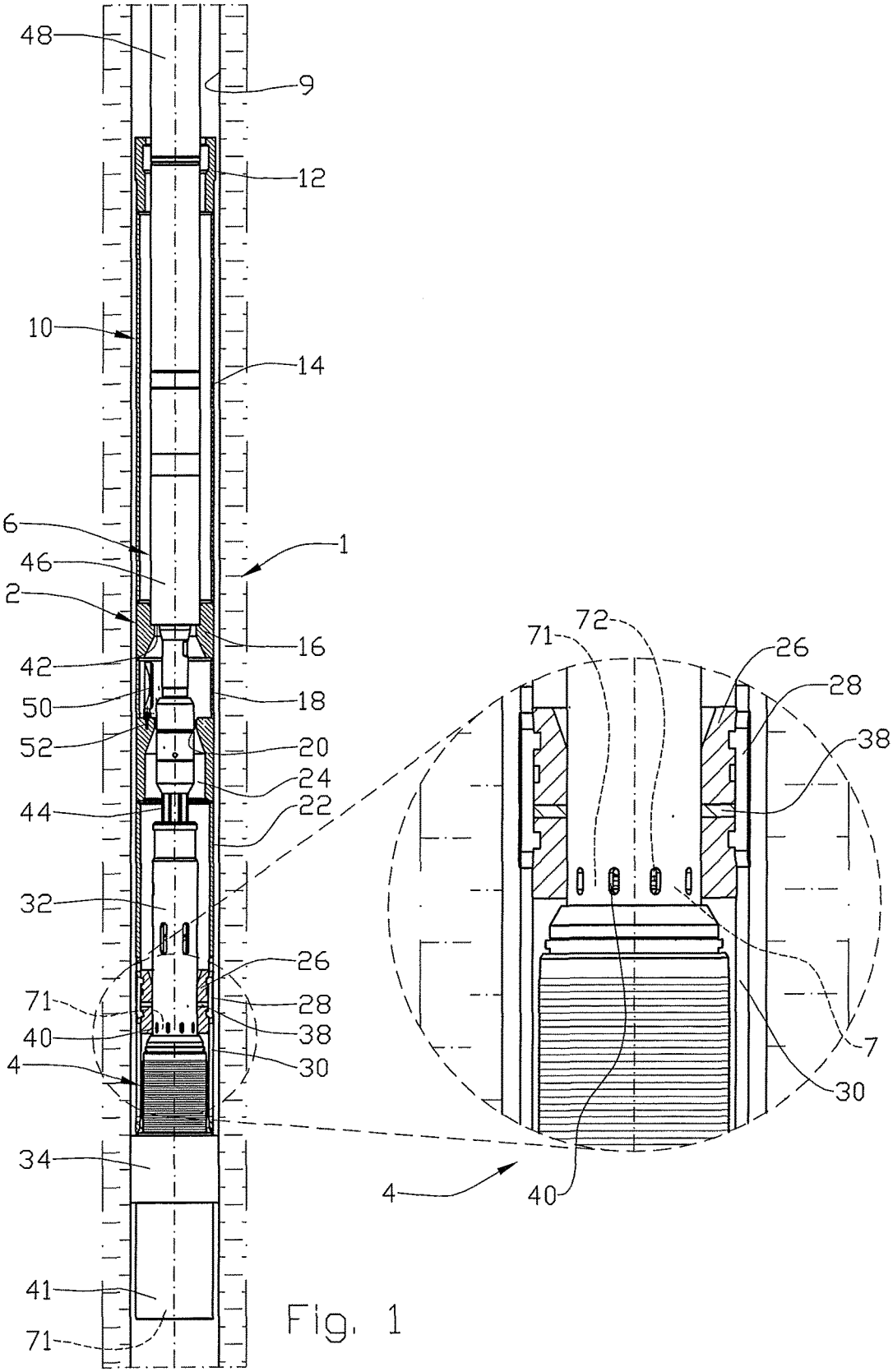
FIG. 1 shows a borehole where a bridge plug is set, a longitudinal section of a junk catcher according to a first embodiment of the invention, and a setting tool in its setting position.

The figures are relatively schematic and only show details and equipment being essential to the understanding of the invention. Further, the figures may be somewhat distorted with respect to the relative dimensions of details and components shown in the figures. The figures may also be somewhat simplified with respect to the shape and richness of detail of such details and components. Hereinafter, equal, equivalent or corresponding details in the figures will be denoted with substantially the same reference numerals.

Figure 2:
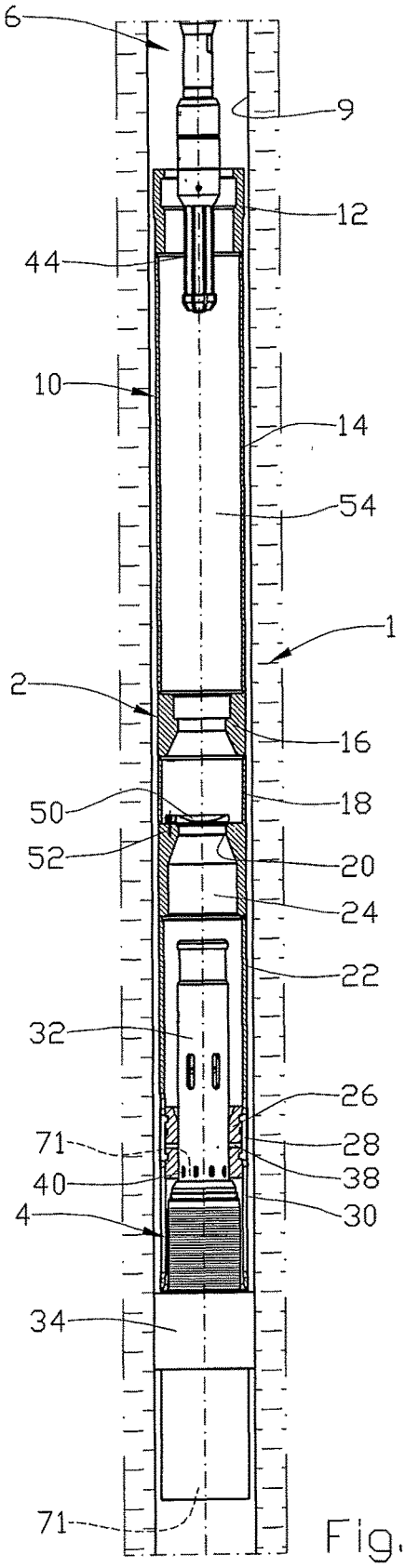
FIG. 2 shows the same as in FIG. 1, but after the setting tool has been released from the bridge plug and partly withdrawn from the junk catcher, and where a closable opening of the junk catcher is closed.
Figure 3:
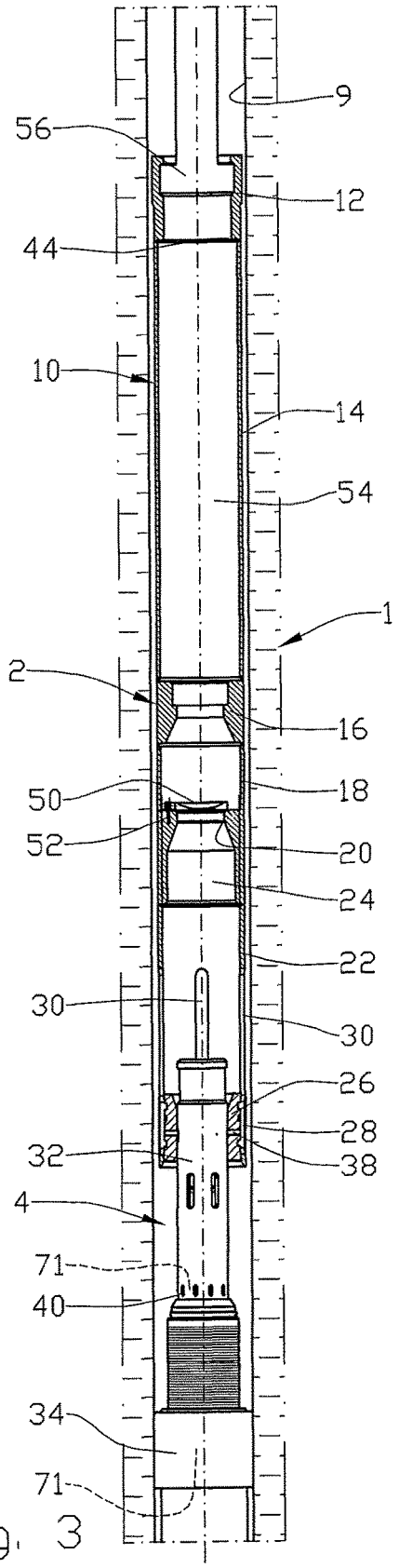
FIG. 3 shows the junk catcher during release from the bridge plug.

On the drawings the reference number 1 denotes an apparatus comprising a junk catcher 2 and a retrievable bridge plug 4. A setting tool 6, which at least partly is positioned inside the junk catcher 2, is connected to the plug 4. In FIGS. 1-3, the apparatus 1 is shown inserted into a borehole 9. The borehole 9 may be open or cased or the apparatus 1 may be inserted in a tubular in the borehole 9.

The junk catcher 2 has a housing 10 that, listed from its upper part in its position of use, includes a so called fishing neck 12, a catcher tube 14, a flanged section 16, a valve chamber 18, a closable opening 20 and a setting sleeve 22 that extends towards the bridge plug 4, see FIG. 1. The functions of each of the components making up the housing 10 are explained below. The housing 10 has a through going axial central opening 24.

Figure 4:
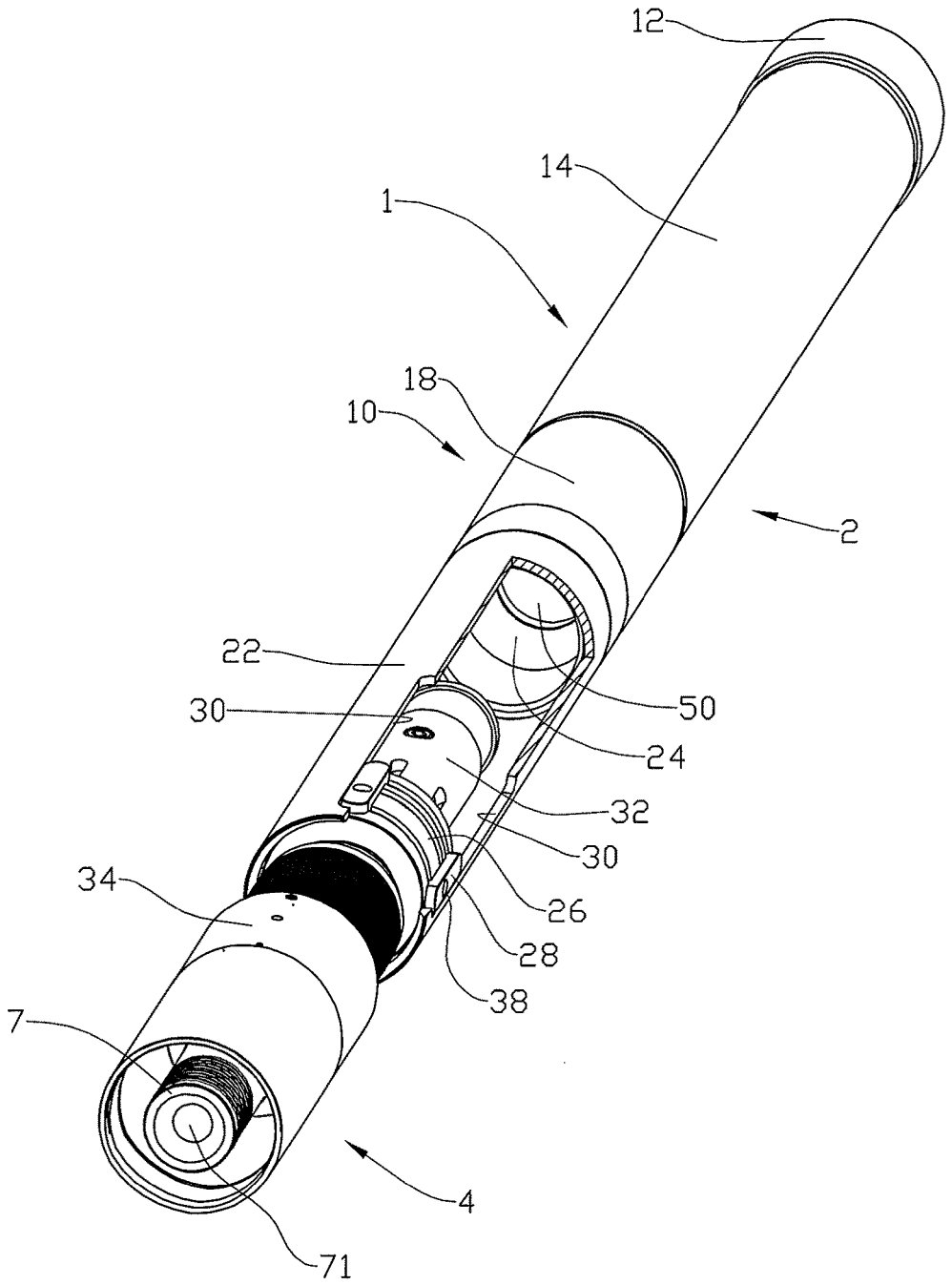
FIG. 4 shows in a different scale a perspective view of the bridge plug and the partly sectioned junk catcher.

Inside the setting sleeve 22 an external closing sleeve 26 is positioned and fastened to the setting sleeve 22. The external closing sleeve 26 is fixed to a number of retainers 28, here four, which are axially movable in separate slots 30 in the setting sleeve 22, see also FIG. 4.

Figure 5:
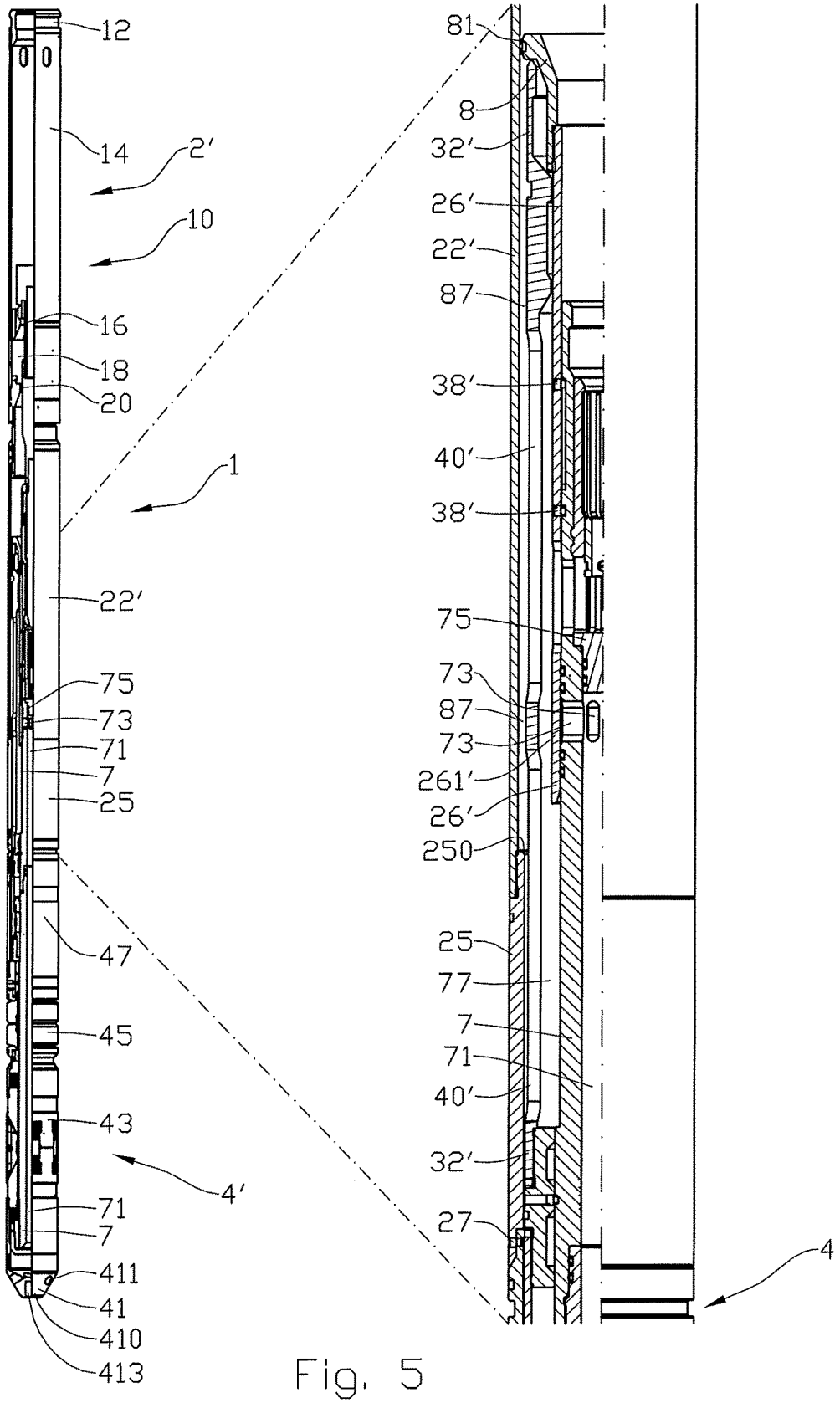
FIG. 5 shows in a different scale a part sectioned view a bridge plug and a junk catcher according to a second embodiment of the invention, and a portion of the bridge plug and the junk catcher at an enlarged scale.

The bridge plug 4, which basically is of a commonly known design, such as disclosed in patent document GB2503202/WO2013164343, has a plug fishing neck 32 that extends in the direction towards the junk catcher 2, and an expansion element 34 that is designed to close the borehole 9 when activated. An equalizing channel 71 inside a mandrel 7 which runs through the bridge plug 4 (see FIG. 4) forms a fluid connection between a bull nose 41 at a lower end portion 410 of the bridge plug 4 in its position of use, and a number of equalizing ports 73 in the mandrel 7 above the bridge plug's 4 packer module 46, as shown in FIG. 5. The equalizing ports 73 are aligned with equalizing holes 40 in the plug fishing neck 32. The closing sleeve 26 covers the equalizing holes 40 and thereby the equalizing ports 73 as well. The closing sleeve 26 is connected to the plug fishing neck 32 by at least one shear bolt 38. The bridge plug 4 also includes other features, such as a retrieval mechanism, not shown, that is known to a skilled person and not further discussed.

The setting tool 6, as shown in FIG. 1, extends into the junk catcher 2. A collar 42 on the setting tool 6 abuts the flanged section 16 of the junk catcher housing 10. A tool centre rod 44 is releasably connected to the plug centre rod 32. The setting tool that is of a well known design is equipped with an actuator 46. The actuator 46 is designed to selectively provide a tensional force in the tool centre rod 44.

The setting tool 6 is connected to the surface in the usual way by use of for instance a tube string 48.

When setting the bridge plug 4, the assembly of junk catcher 2, bridge plug 4 and setting tool 6 is positioned in the borehole 9. Thereafter, the actuator 46 is activated, exerting a pulling force via the tool centre rod 44 to the plug fishing neck 32. The pulling force is counteracted by a compressive force between the collar 42 and flange section 16. The compressive force acts on the bridge plug 4 via the valve chamber 18 and the setting sleeve 22.

Said forces move the setting sleeve 22 along the bridge plug 4 while the retainers 28 are moved in their slots 30, bringing the expansion element 34 of the bridge plug 4 to close against the borehole 9.

When the bridge plug 4 is set with the required force, the tool centre rod 44 is released from the plug fishing neck 32 and the setting tool 6 extracted from the junk catcher 2. The situation is shown in FIG. 2 where the setting tool 6 is being withdrawn from the junk catcher 2. The closing sleeve 26 covers the equalizing holes 40 as shown in FIGS. 1 and 2. Necessary sealing elements are not shown.

The removal of the setting tool 6 from the junk catcher 2 allows a valve 50, which is present in the valve chamber 18 and activated by an actuating device 52, here in the form of a spring, to close the closable opening 20.

In this situation, the fishing neck 12, catcher tube 14 and the valve 50 are making up an upwardly open catching room 54 that is designed to collect sand and other debris and prevent them from reaching the bridge plug 4.

When the bridge plug 4 is to be removed, a fishing tool 56 is connected to the fishing neck 12 of the junk catcher 2. The junk catcher 2 is pulled in the direction away from the bridge plug 4 and the retainers 28 are moving to their end positions in their slots 30. Further pulling force moves the junk catcher 2 further relative the bridge plug 4 and shear off the at least one shear bolt 38 and the closing sleeve 26 is displaced along the plug fishing neck 32 and away from the equalizing holes 40. The equalizing channel 71 is then open. Fluid flows through the equalizing channel 71 and equalizes the well pressure under and above the bridge plug 4. The fluid may flow from under the bridge plug 4 to above the bridge plug 4, or vice versa, depending on the pressure difference. The released junk catcher 2 may then be drawn up to the surface. At the surface a visual inspection of the setting sleeve 22 will document the presence of the closing sleeve 26 and thereby confirm that the equalizing channel 71 is open. The pressure equalizing over the bridge plug 4 is ongoing when the junk catcher 2 is being retrieved.

The bridge plug 4 may then be retrieved by use of a conventional, not shown, retrieval tool. The retrieval tool may retrieve the bridge plug 4 without waiting for the pressure to be equalized and thereby time is saved.

Figure 6:
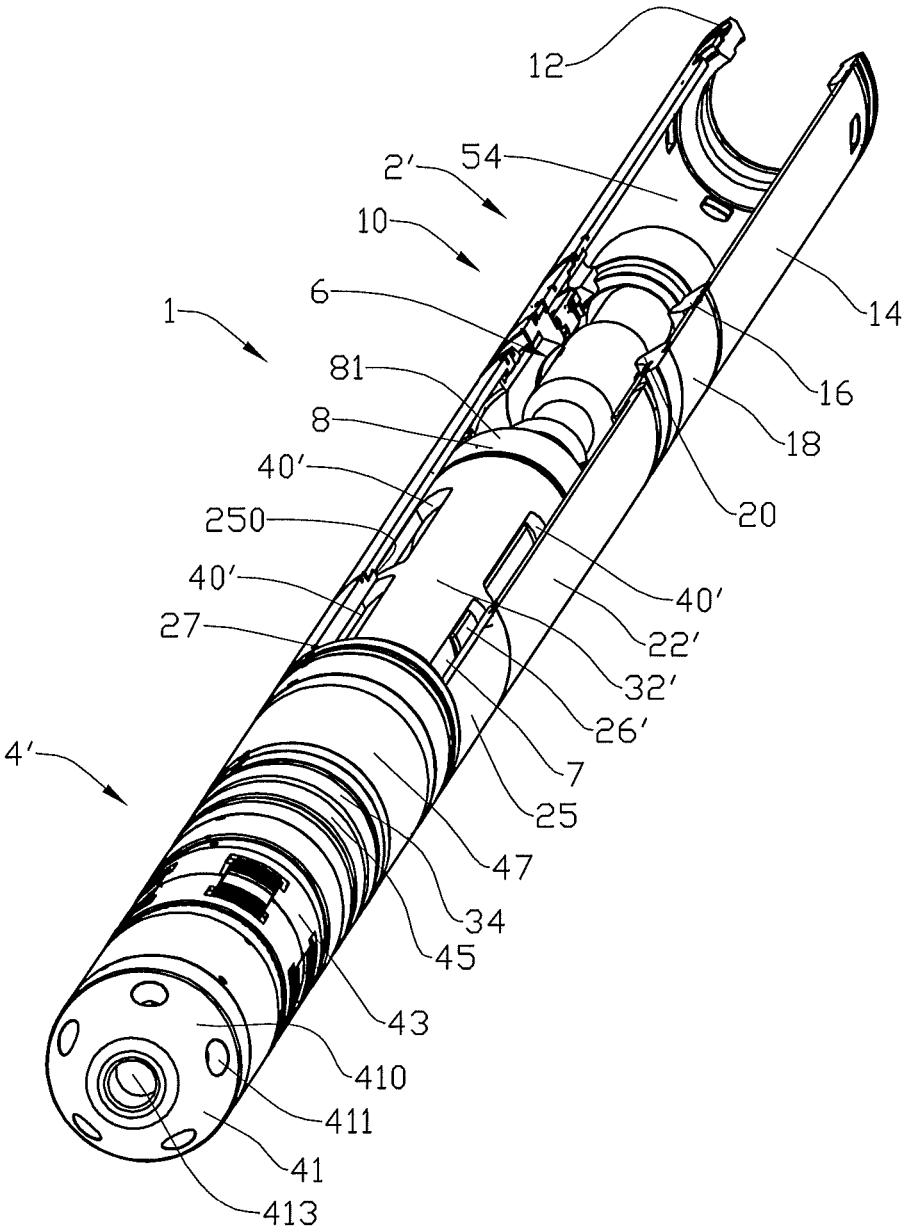
FIG. 6 shows in a different scale a perspective view with a cut away portion the bridge plug and the junk catcher in a setting mode with a portion of a setting tool.
Figure 7:
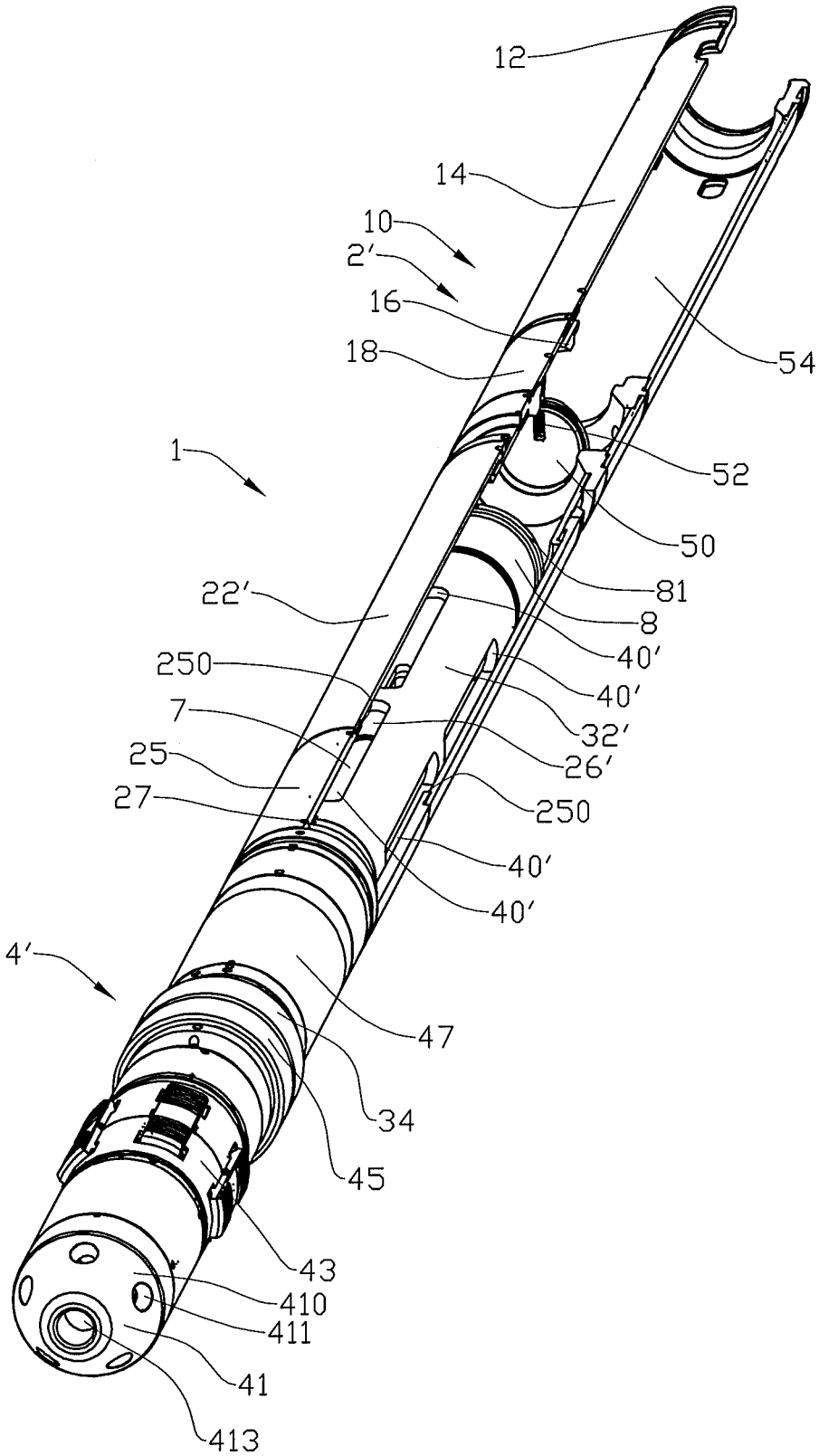
FIG. 7 shows in a different scale the same as FIG. 6 after setting of the bridge plug and retrieval of the setting tool.

FIGS. 5-7 show a second embodiment of the invention. FIG. 5 shows a junk catcher 2' and a retrievable bridge plug 4'. The junk catcher 2' comprises many of the same elements as the junk catcher 2 shown in FIGS. 1-4. Same elements are shown with the same reference numeral and these are not further discussed here.

A setting sleeve 22' is fastened to a carrier sleeve 25. The carrier sleeve 25 forms a stiff elongation of the setting sleeve 22'. The carrier sleeve 25 is fastened to the bridge plug 4 by at least one shear bolt 27, as seen in the detailed drawing in FIG. 5.

The setting sleeve 22' and the carrier sleeve 25 surround a portion of a plug fishing neck 32'. The function of the carrier sleeve 25 is described below.

The bridge plug 4' comprises from its end a bull nose 41, an anchor module 43, a packer module 45, a ratchet tube 47 as known in the art, and described in further detail in GB2503202/WO2013164343. The bull nose 41 comprises a plurality of channels 411 which on the inside of the bull nose 41 are in open fluid communication with the equalizing channel 71 in the mandrel 7. The bull nose 41 is at its free end portion provided with a threaded hole 413 to which other equipment may be attached, as known in the art.

The mandrel 7 is provided with at least one equalizing port 73 at the end of the equalizing channel 71 at the opposite end of the bullet nose 41. The equalizing port 73 is positioned at the opposite side of the bridge plug's 4' anchor module 43, packer module 45 and ratchet tube 47 relative to the bull nose 41. The equalizing channel 71 is at its end closed with a removable plug 75.

During setting of the bridge plug 4' and the junk catcher 2' and prior to retrieval of the junk catcher 2', the equalizing port 73 is closed by an internal closing sleeve 26' which is positioned in an annulus 77 formed between the mandrel 7 and the plug fishing neck 32'. The closing sleeve's 26' closing end 261' is covering the equalizing port 73.

The closing sleeve 26' is fastened to the bridge plug 4' by at least one shear bolt 38'. Two shear bolts 38' are shown in FIG. 5.

The closing sleeve 26' is at its end opposite the closing end 261' threadedly fastened to a collar 8. The collar 8 projects over the plug fishing neck 32' in the direction of the junk catcher 2'. An outer rim 81 of the collar 8 faces the inner surface of the setting sleeve 22'. The carrier sleeve 25 is shown with a wall thickness that is larger than the wall thickness of the setting sleeve 22'. A shoulder 250 is formed by the carrier sleeve 25 at the inside of the setting sleeve 22' at the joint between the setting sleeve 22' and the carrier sleeve 25. The setting sleeve 22' and the plug fishing neck 32' form an annulus 87 between the shoulder 250 and the collar 8.

When the plug 4' is to be removed, a fishing tool 56 is connected to the fishing neck 12 of the junk catcher 2'. The junk catcher 2' is pulled in a direction away from the bridge plug 4'. The shear bolt 27 is sheared off by the pulling force and the junk catcher 2' with the setting sleeve 22' and the carrier sleeve 25 move relative to the plug fishing neck 32'. This movement continues until the shoulder 250 of the carrier sleeve 25 abuts the rim 81 of the collar 8. Further pulling force on the junk catcher 2' is transferred to the collar 8 and the closing sleeve 26'. The shear bolts 38' are broken and the collar 8 and the closing sleeve 26' follow the junk catcher 2' away from the bridge plug 4' and is retrieved together with the junk catcher 2'. At the surface the closing sleeve 26' will protrude from the carrier sleeve 25. The protruding closing sleeve 26' is a visual confirmation that the equalizing ports 73 have been opened.

After the removal of the closing sleeve 26', fluid is free to flow through the channels 411, through the equalizing channel 71, through the equalizing ports 73, through the annulus 87 and through openings 40' in the plug fishing neck 32', or vice versa. The fluid pressure becomes equal under and above the bridge plug 4'. Equalizing of the pressure is ongoing on retrieval of the junk catcher 2'. A retrieval tool for retrieving the bridge plug 4' can then be lowered into the borehole 9 immediately after retrieving the junk catcher 2', and the retrieval tool may retrieve the bridge plug 4' without further waiting for the pressure to equalize. Thereby time is saved.

In a third embodiment (not shown), a bridge plug similar to the bridge plug 4' is set without a junk catcher. A different closing sleeve is positioned in the annulus 77. On retrieval of the bridge plug, a retrieval tool (not shown) pushes the closing sleeve towards the bull nose 41. An opening in the closing sleeve aligns with the equalizing port 73. Fluid flows through the equalizing channel 71 and equalizes the well pressure under and above the bridge plug.

The invention claimed is:

1. A junk catcher ( 2, 2'), said junk catcher comprising:

the junk catcher (2, 2') being releasable connected to a retrievable bridge plug (4, 4'), the retrievable bridge plug (4, 4') being connectable to a setting tool (6) for the deployment of the bridge plug (4, 4') and the junk catcher (2, 2') in a borehole (9) or a tubular in the borehole (9);

the setting tool (6) extends through a fishing neck (12), a catcher tube (14), a flanged section (16), a valve chamber (18), a closable opening (20) and a portion of a setting sleeve (22, 22') of the junk catcher (2, 2');

the valve chamber (18) comprises a valve (50) arranged to close the closable opening (20) after retrieval of the setting tool (6) from the junk catcher (2, 2');

the junk catcher (2, 2') being connected to the bridge plug (4, 4') by at least one shear bolt (27, 38), the bridge plug (4, 4') comprises a plug fishing neck (32, 32') facing the junk catcher (2, 2'), and the bridge plug (4, 4') comprises an equalizing channel (71) in a mandrel (7), the equalizing channel (71) extending from a bull nose (41) of the bridge plug (4, 4');

the junk catcher (2, 2') being provided with a closing sleeve (26, 26'), connected to the bridge plug (4, 4') by at least one shear bolt (38, 38'), and the closing sleeve (26, 26') seals at least one equalizing port (73) in the mandrel (7) when the bridge plug (4, 4') is set.

2. The junk catcher (2) according to claim 1, wherein the closing sleeve (26) seals an equalizing hole (40) aligned with the equalizing port (73) by enclosing the plug fishing neck (32) from the outside.

3. The junk catcher (2') according to claim 1, wherein the closing sleeve (26') is positioned in an annulus (77) between the plug fishing neck (32') and the mandrel (7), and seals at least one equalizing port (73) in the mandrel (7).

4. The junk catcher (2') according to claim 3, wherein the setting sleeve (22') comprises an internal shoulder (250) positioned in an annulus (87) between the setting sleeve (22') and the plug fishing neck (32'), the shoulder (250) upon axial displacement relative to the plug fishing neck (32') abuts a collar (8) projecting over the plug fishing neck (32'), and the collar (8) is connected to the closing sleeve (26').

5. The junk catcher (2') according to claim 4, wherein the internal shoulder (250) is formed by a carrier sleeve (25), the carrier sleeve (25) is connected to and forming an elongation of the setting sleeve (22').

6. The junk catcher (2, 2') according to claim 1, wherein the valve (50) has an actuating device (52).

7. The junk catcher and bridge plug assembly comprising a junk catcher (2, 2') according to claim 1 and where the bridge plug (4, 4') is provided with at least one equalizing port (73) closable by a closing sleeve (26, 26') which is retrievable together with the junk catcher (2, 2').

8. A method of operation of a junk catcher (2, 2') according to claim 1, the method includes:

connecting the junk catcher (2, 2') that has a closable opening (20) for a setting tool (6), to a retrievable bridge plug (4, 4');

connecting the setting tool (6) to the bridge plug (4, 4');

positioning the junk catcher (2, 2') and the bridge plug (4, 4') downhole;

setting the bridge plug (4, 4'); and retrieving the setting tool (6), characterized in that the method further includes:

retrieving the junk catcher (2, 2') together with a closing sleeve (26, 26') which on retrieval displaces axially along a plug fishing neck (32, 32') of the bridge plug (4, 4'); and opening at least one equalizing port (73) in a mandrel (7) by the displacement of the closing sleeve (26, 26') such that an open channel forms from a bull nose (41) and through the bridge plug (4, 4'), such that pressure may equalize under and above the bridge plug (4, 4') when the junk catcher (2, 2') is retrieved.

9. A method of operation of a junk catcher (2, 2') according to claim 8, where the method further comprises to inspect a the junk catcher (2, 2') for the presence of the closing sleeve (26, 26') at the surface to confirm that the at least one equalizing port (73) has been opened.

* * * * *